US008397388B1

(12) United States Patent
Steinberg

(10) Patent No.: US 8,397,388 B1
(45) Date of Patent: Mar. 19, 2013

(54) ROTARY SHAVER PLATFORM ROTATION SYSTEM

(76) Inventor: Hy Steinberg, Tamarac, FL (US)

( * ) Notice: Subject to any disclaimer, the term of this patent is extended or adjusted under 35 U.S.C. 154(b) by 0 days.

(21) Appl. No.: 13/373,021

(22) Filed: Nov. 3, 2011

(51) Int. Cl.
*B26B 19/14* (2006.01)

(52) U.S. Cl. ..... 30/43.5; 30/43.6

(58) Field of Classification Search ..... 30/43.1, 30/43.3–43.92, 34.1
See application file for complete search history.

(56) References Cited

U.S. PATENT DOCUMENTS

| | | | | | |
|---|---|---|---|---|---|
| 926,509 | A | * | 6/1909 | Rankin | 30/43.1 |
| 2,186,092 | A | * | 1/1940 | Benner | 30/43.1 |
| 2,194,815 | A | * | 3/1940 | Testi | 30/43.1 |
| 2,283,834 | A | * | 5/1942 | Van Dam et al. | 30/43.5 |
| 2,396,181 | A | * | 3/1946 | Kerwer | 30/43.5 |
| 3,264,734 | A | * | 8/1966 | Starre | 30/43.5 |
| 3,287,805 | A | * | 11/1966 | Du Charme | 30/34.1 |
| 3,339,276 | A | * | 9/1967 | Tolmie et al. | 30/43.1 |
| 3,406,448 | A | * | 10/1968 | MacCarthy | 30/43.8 |
| 3,797,109 | A | * | 3/1974 | Yamada et al. | 30/43.1 |
| 3,945,115 | A | * | 3/1976 | Daniels et al. | 30/43.1 |
| 4,038,747 | A | * | 8/1977 | Upton | 30/43.7 |
| 5,007,168 | A | * | 4/1991 | Messinger et al. | 30/43.6 |
| 5,052,106 | A | * | 10/1991 | Labrijn | 30/34.1 |
| 5,983,501 | A | * | 11/1999 | Izumi | 30/43.5 |
| 6,212,776 | B1 | * | 4/2001 | Izumi et al. | 30/43.5 |
| 6,553,668 | B1 | * | 4/2003 | Steinberg | 30/43.5 |
| 6,584,691 | B1 | * | 7/2003 | Gerasimov et al. | 30/43.6 |
| 6,901,662 | B1 | * | 6/2005 | Steinberg | 30/43.5 |
| 6,931,731 | B2 | * | 8/2005 | Izumi et al. | 30/43.1 |
| 6,976,312 | B2 | * | 12/2005 | Wiler | 30/43.6 |
| 7,020,965 | B2 | * | 4/2006 | Bao | 30/43.6 |
| 7,022,042 | B2 | * | 4/2006 | Fleytman | 475/333 |
| 7,503,118 | B2 | * | 3/2009 | Oh | 30/43.1 |
| 2008/0134513 | A1 | * | 6/2008 | Oh | 30/43.6 |
| 2008/0141537 | A1 | * | 6/2008 | Oh | 30/42 |

FOREIGN PATENT DOCUMENTS

FR 1362062 * 4/1964

* cited by examiner

*Primary Examiner* — Jason Daniel Prone

(57) ABSTRACT

A shaver incorporating rotary cutters included in a rotary platform. The platform and rotary cutters are both rotated by a motor and gear chains housed within the shaver.

3 Claims, 2 Drawing Sheets

TOP VIEW SECTION A-A

ROTARY SHAVER PLATFORM ROTATION SYSTEM

BACKGROUND OF THE INVENTION

The significant past improvements of the rotary electric shaver have generally been focused on the shaver's ability to thread every hair end completely through a tiny opening in a metallic screen and cut it close to the skin as easily as done by the single stroke of a razor blade. However, the natural variation in growth angle of facial hair prevents the close-cutting of hair ends that are not positioned to fully penetrate the metallic screen during a single movement of the screen. Although rotary electric shavers can lift and push most hair ends into position for cutting, they cannot cut all hair ends underneath the perforated screens without multiple back-and-forth scrubbing movements of the shaver body. Because of this handicap, rotary shaver manufacturers recommend the use of circular movements of the shaver body in order to achieve a closer shave. This significant recommendation appears in the instruction manuals of all major rotary shaver manufacturers and is an unavoidable admission that a circular movement of the shaver's cutting head platform will produce a closer shave. Unfortunately, the circular and repeated straight movements of the shaver body are tiresome and particularly difficult over face areas that are not accessed easily, such as under the nose and chin and around the lips. These burdensome requirements for manipulation and irregular movements of the shaver body have continued to inhibit the wider acceptance and use of the rotary electric shaver. Many attempts to increase the efficiency of the multi-headed rotary shaver's cutting heads and overcome all the impediments to a closer shave have been described in earlier patents wherein various vibrating, arcuate and other modified circular movements of the shaving platform have been proposed without much success. The problem of achieving a close shave with minimal effort and only straight movements of the shaver body was not overcome until an uninterrupted circular rotation system for the shaving platform was introduced in U.S. Pat. No. 6,553,668b1. This platform provided a uniform lateral rotation path for the cutting head screens and geometrically compounded the circular movements of the cutting blades underneath the perforated screens. The combination of these circular movements produced a shaving performance that surpassed the performance of multiple circular and straight movements of the entire shaver body in all directions. They removed the escape paths for disoriented hairs, ended the need for repeated movements of the shaver body and ended the need to rotate or manipulate the shaver in order to reach irregular face areas. Furthermore, the time and effort required for a close shave with a rotary shaver was drastically reduced. Unlike the shaving action of other rotary shavers, the shaving action of the rotating platform described herein is demonstrable. Upon contact with the skin, the area under the platform's cutting heads is instantly shaved clean, without any movement of the shaver body. With all other rotary shavers, the hair ends will remain uncut if the shaver is placed upon the skin surface without movement of the entire shaver body.

SUMMARY OF THE INVENTION

The proposed improvements described herein for the rotating platform of the rotary shaver described herein, and in U.S. Pat. No. 6,553,668 b1, provide a completely independent and balanced drive means with increased torque power for the rotating platform and also eliminate any interference with the shaver's drive means for the cutter blades. The extent of the advantages of the rotating platform depend upon the speed of its rotation. The size and configuration of the gear components illustrated herein are adaptable for producing fixed platform rotation speeds of approximately 1 to 4 revolutions per second, which includes the most practical and effective rotation speeds for the user.

DESCRIPTION OF INVENTION

Figure 1:
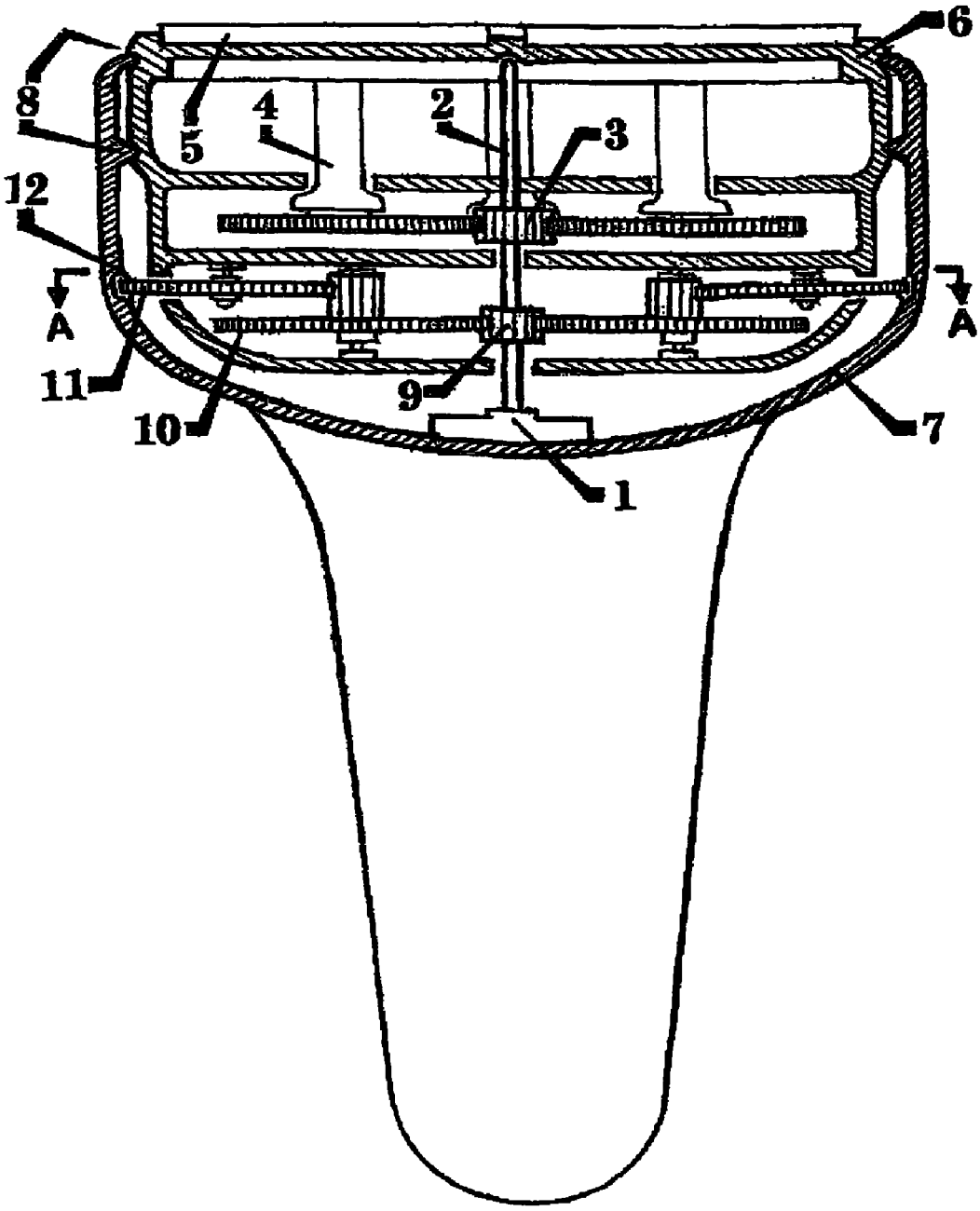
FIG. 1 is an elevation side view of the top, interior portion of the rotary electric shaver with a portion of the outer body and rotating platform removed to illustrate a side view of the interior gear arrangements surrounding the motor axis.

FIG. 1 shows a shaver with a head portion (7) and a handle portion. The head portion (7) defines an opening that houses a motor (1) with a rotating drive shaft (2) having upper and lower spur gears (3, 9). The opening receives a rotating platform (6) featuring a plurality of cavities. A lower cavity houses three identical balanced equidistantly spaced gear chains. Each gear chain has a lower inner gear (10) that is supported by a base portion of the cavity and engages the lower spur gear (9) and an upper outer gear (11) that is supported by a ceiling portion of the cavity and engages the lower gear (10). The head portion (7) also includes a ring gear (12) that extends around the periphery of the opening of the head portion (7). Rotation of the shaft (2) by the motor (1) rotates each of the gears (10, 11) and thereby rotates the platform (6) relative to the head portion (7) via the interaction between the ring gear (12) and the upper outer gear (11). The rotating platform (6) incorporates at least two rotary cutters (5) each connected to a pinion (4) that is connected to a gear portion. Each of the gear portions engages the upper spur gear (3). Rotation of the upper spur gear (3) via the motor (1) and drive shaft (2) thereby rotate the at least two rotary cutters (5). The periphery of the opening of the head portion (7) also includes projecting portions (8) that are received within corresponding depressions on the platform (6). Interaction between the projecting portions (8) and the depressions provide a fixed alignment and stabilizing force for the platform (6) within the head portion (7).

Figure 2:
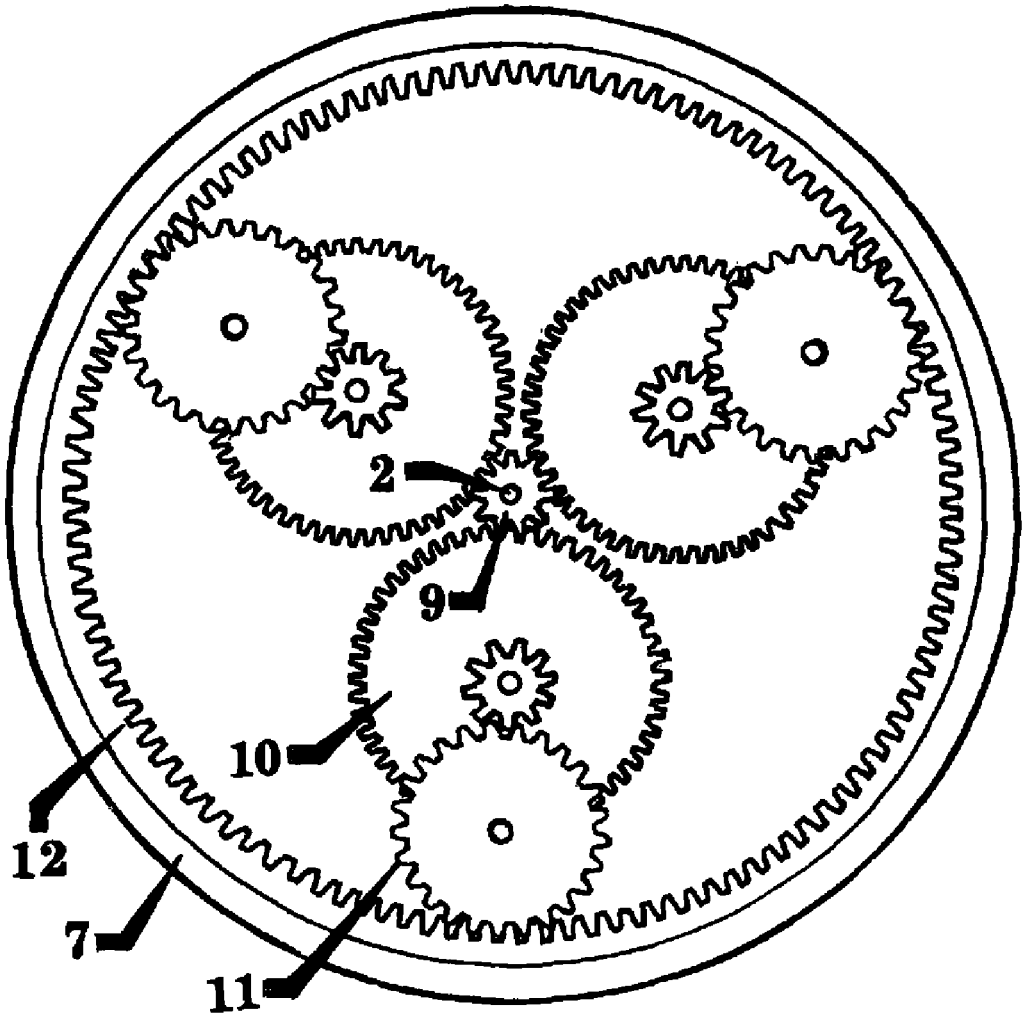
FIG. 2 is a top plan view (A-A in FIG. 1) of the shaver's interior structure illustrating a preferred independent and balanced gear chain arrangement for driving the rotating platform.

The preferred embodiment of the invention is shown in FIG. 2, which is a top view of Section A-A in FIG. 1, wherein the gear chains reduce the speed of the platform (6) to a speed desired within the most effective range of 1 to 4 revolutions per second.

The appropriate speed range for platform rotation can be chosen by the manufacturer and would depend upon marketing and sales decisions The precise number of teeth and diameters of each of the gears would also depend upon a speed chosen for the drive motor (1) and the diameter of the ring gear (12) within the opening of the head portion (7).

The use of the at least three identical balanced equidistantly spaced gear chains to rotate the platform (6) prevents the imposition of spurious vibratory or oscillatory movements to the platform (6) that can alter and diminish the cutting efficiency of the cutters (5) on the platform (6). To prevent damage to all of the internal that rotate the platform (6) during an accidental interruption of the rotation of the platform, the ring gear (12) can be disengaged and enabled to move laterally, in either direction, by the use of a lever mechanism.

If desired, an inner compartment area between a base of the platform (6) and the head portion (7) can be utilized to accommodate an independently operated drive element for a reciprocating pop-up trimmer by adding a spur gear or speed-reducing worm gear that is operably engaged with the motor (1) and a rigid internal base structure above the motor to support the drive element. Further linkages to reciprocate trimmer blades can be incorporated by any one of several know means for converting a rotary motion produced by the motor (1) to a reciprocal movement required for a reciprocating pop-up trimmer.

I claim:

1. A shaver comprising: at least two cutters each with a driving shaft; a head portion defining an opening with a ring gear extending around an inner periphery of the opening; a rotating structure received in the opening of the head portion, the rotating structure defining a plurality of cavities each with a base and a ceiling; a motor having a drive shaft with an upper and lower spur gear received in the opening of the head portion; at least two identical balanced equidistantly spaced gear chains, wherein at least one gear of each of the at least two gear chains is supported by a base of one of the plurality of cavities and at least another gear of each of the at least two gear chains is supported by the ceiling of the one of the plurality of cavities, each of the at least two gear chains is engaged with the lower spur gear and the ring gear, wherein rotation of the of the motor drive shaft rotates the rotating structure without vibration; at least two driving gears in another one of the plurality of cavities, each of the at least two driving gears engaging the upper spur gear and a respective one of the driving shafts, wherein the rotation of the motor drive shaft rotates the at least two cutters.

2. The shaver of claim 1, wherein the at least two identical balanced equidistantly spaced gear chains is three identical balanced equidistantly spaced gear chains and each of the three identical balanced equidistantly spaced gear chains is engaged with the lower spur gear and the ring gear.

3. The shaver of claim 1, wherein the rotating structure has a top surface extending from the opening and defining at least two openings, wherein each of the at least two openings receives a respective one of the at least two cutters.

* * * * *